United States Patent [19]

Klingler

[11] 4,399,928

[45] Aug. 23, 1983

[54] CLOSURE CAP

[75] Inventor: Josef F. Klingler, Wilmette, Ill.

[73] Assignee: Janler Corporation, Chicago, Ill.

[21] Appl. No.: 368,369

[22] Filed: Apr. 14, 1982

[51] Int. Cl.[3] ..... B65D 43/24

[52] U.S. Cl. ..... 220/335; 215/237; 222/517

[58] Field of Search ..... 220/335; 215/237, 235; 222/517, 536, 153

[56] References Cited

U.S. PATENT DOCUMENTS

| | | | |
|---|---|---|---|
| 3,651,992 | 3/1972 | Hazard | 215/237 |
| 3,752,371 | 8/1973 | Susuki et al. | 222/517 |
| 4,124,151 | 11/1978 | Hazard | 220/335 |
| 4,261,486 | 4/1981 | Bush et al. | 222/517 |

*Primary Examiner*—George T. Hall

*Attorney, Agent, or Firm*—Wood, Dalton, Phillips, Mason & Rowe

[57] ABSTRACT

A closure cap defining a dispenser port. A stopper tab is pivotally mounted to the closure cap for selectively closing the port. The closure cap includes an end wall having a concave portion defining a camming surface. A resilient finger is provided on the stopper tab and includes a tip portion slidably engaging the camming surface. The finger tip is deflected by its engagement with the camming surface when the stopper tab is arranged in the port-closing disposition so as to bias the stopper tab toward the axis of the pivot portion. The finger tip coacts with the camming surface further to bias the stopper tab pivotally toward an open position wherein the stopper portion is spaced from the port as a result of the stopper tab being moved from the port-closing disposition. The camming surface further coacts with the stopper tab to releasably retain the stopper tab in the fully open pivotal position.

10 Claims, 4 Drawing Figures

FIG. 1
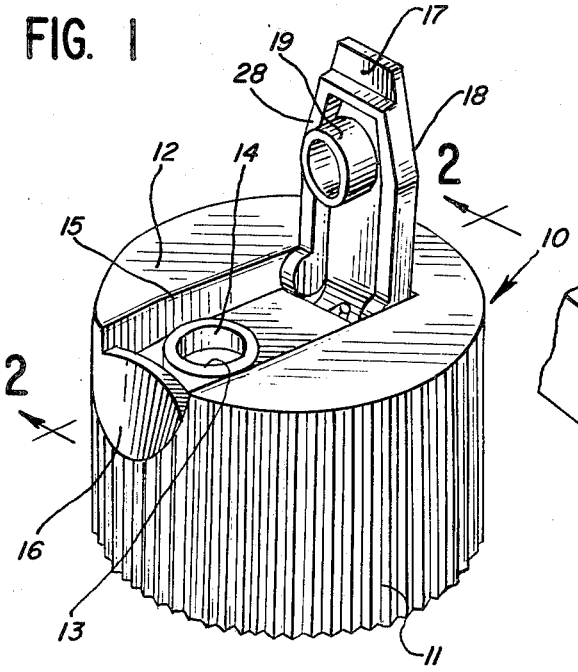
FIG. 3
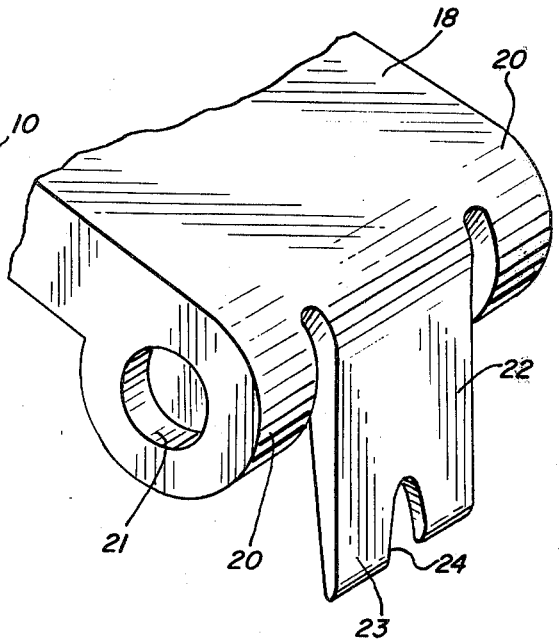
FIG. 4
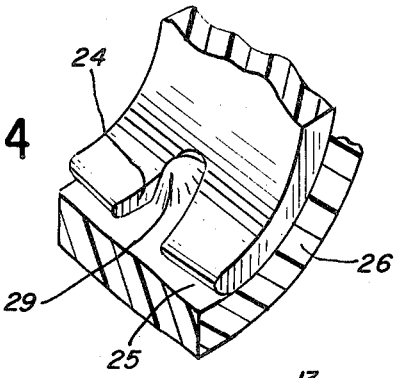
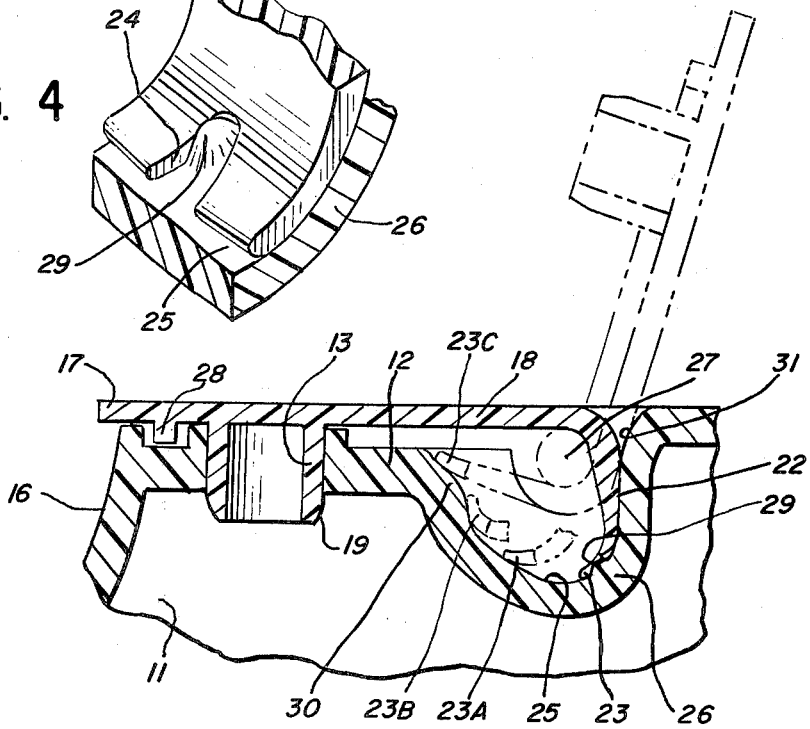
FIG. 2

CLOSURE CAP

BACKGROUND OF THE INVENTION

1. Field of the Invention

This invention relates to closure caps and in particular to closure caps having a selectively closable port therein.

2. Description of the Background Art

In one form of known closure cap, the cap is provided with a connecting portion adapted to be connected to an outlet of a container holding flowable material. A distal portion of the cap is provided with a port through which the flowable material may be dispense as desired.

A number of different forms of stopper tabs have been provided heretofore for selectively closing the port of such a closure cap. In one form, the stopper tab is freely pivotally mounted to the closure cap. A retaining tab may be provided for overcenter retention of the stopper tab in a fully open position.

Other forms of stopper tab mountings have been provided heretofore, none of which has proven completely successful in the desirable control of the selective delivery of the flowable material through the closure cap port.

SUMMARY OF THE INVENTION

The present invention comprehends an improved closure cap structure having means for resiliently biasing the stopper tab for improved selective flow control through the tab port.

More specifically, the invention comprehends the provision of camming means on the closure cap cooperating with a resilient finger on the stopper tab for providing a novel control of the positioning of the stopper tab in use.

In the illustrated embodiment, the closure cap includes the connecting portion in a distal end wall defining a dispenser port. The stopper tab has a finger manipulating portion, a stopper portion arranged to be fitted removably in the dispenser port for selectively closing the same. The stopper tab further includes a pivot portion pivotally mounted to the closure cap, and in the illustrated embodiment, is mounted to the end wall thereof.

The invention comprehends the provision of a concave portion of the end wall defining a camming surface and a resilient finger on the stopper tab having a tip portion slidably engaging the camming surface.

In the illustrated embodiment, the camming surface defines means for causing the finger tip to be deflected by its engagement with the camming surface when the stopper tab is arranged with the stopper portion received in said port so as to bias the stopper tab toward the axis of the pivot portion.

In the illustrated embodiment, the camming suface further defines means for causing the finger tip to bias the stopper tab pivotally toward an open position wherein the stopper portion is spaced from the dispenser port as a result of the stopper tab being moved from the port-closing disposition.

In the illustrated embodiment, the camming surface further defines retaining means for causing the stopper tab to be releasably retained in a fully open pivotal position.

The end wall in the illustrated embodiment further defines shoulder means for engaging a portion of the stopper tab for releasably locking the stopper tab in the closed position.

In the illustrated embodiment, the tip portion of the stopper tab finger portion is provided with a recess and the end wall further defines shoulder means for engaging the tip portion in the recess for releasably locking the stopper tab in the closed position.

In the illustrated embodiment, the closure cap includes shoulder means for releasably retaining the stopper tab in the fully open pivotal position.

As shown in the illustrated embodiment, the shoulder means is arranged to guide the finger tip therepast as the stopper tab is pivoted to the fully open position.

In the fully open position, the finger tip is substantially undeflected while being disposed pivotally beyond the shoulder means.

The end wall of the closure cap further defines, in the illustrated embodiment, a limit stop surface engageable by the stopper tab when the stopper tab is in the fully open position for preventing pivotal movement of the stopper tab beyond the fully open position.

Thus, the closure cap of the present invention is extremely simple and economical of construction while yet providing a highly improved control of the dispenser port thereof.

BRIEF DESCRIPTION OF THE DRAWING

Other features and advantages of the invention will be apparent from the following description taken in connection with the accompanying drawing wherein:

FIG. 1 is an isometric view of a closure cap embodying the invention;

FIG. 2 is a fragmentary enlarged section thereof taken substantially along the line 2—2 of FIG. 1;

FIG. 3 is a fragmentary enlarged perspective view of the resilient finger of the stopper tab; and FIG. 4 is a fragmentary perspective view illustrating the engagement of the distal tip of the resilient finger, with the retaining shoulder on the camming surface of the closure cap.

DESCRIPTION OF THE PREFERRED EMBODIMENT

In the illustrative embodiment of the invention as disclosed in the drawing, a closure cap generally designated 10 is provided with a connecting portion 11 and a distal end wall 12. Illustratively, the connecting portion may be internally threaded for threaded relationship with a flowable material container (not shown).

End wall 12 defines a dispenser portion 13 for selective passage of the flowable material from the container as desired. As seen in FIG. 1, the dispenser port in the illustrated embodiment is defined by an upstanding annular wall 14 disposed within a recess 15 opening at one end into the side of the connecting portion 11. As further seen in FIG. 1, a clearance recess 16 extends downwardly from the recess 15 such as for receiving a person's fingertip or fingernail for engagement with a distal end portion 17 of a stopper tab 18. Stopper tab 18 further includes a stopper portion 19 adapted to be selectively received in the dispenser port 13 radially within the port wall 14 in the closed disposition of the closure cap. Thus, in the closed disposition, the tip portion 17 overlies the recess 16 to defines a fingertip manipulation portion of the stopper tab.

As best seen in FIG. 3, the stopper tap includes a pivot portion 20 having pivot holes 21 for pivotally receiving suitable projecting pivot pin portions on the cap wall 12 to permit pivotal swinging of the stopper tab between the closed position illustrated in full lines in FIG. 2 and the open position illustrated in FIG. 1.

As further seen in FIG. 3, the rear end of the stopper tab is provided with a depending, resilient finger 22 extending from intermediate the pivotal portions 20 and having a tip portion 23 provided with a notch, or recess, 24. As seen in FIG. 3, the finger tapers toward the distal end 23 for improved control of the resiliency of the finger in controlling the movement of the stopper tab, as brought out more fully hereinafter.

As best seen in FIG. 2, finger 22 extends downwardly into a recess 25 defined by a concave portion 26 of end wall 12 rearwardly of the dispenser port 13. In the closed disposition of the stopper tab illustrated in full lines in FIG. 2, distal end 23 of the finger 22 is deflected by its engagement with the camming surface 25 in such a manner as to act radially toward the axis 27 of the tab pivot means. As shown in FIG. 2, in the closed disposition, a depending flange 28 on the underside of the tab 18 abuts the top surface of wall 12 to limit the downward insertion of the stopper portion 19 of stopper tab 18 into the dispenser port.

As seen in FIG. 4, camming surface 25 is provided with an upstanding rounded stop shoulder 29 disposed to be received in the notch 24 when the stopper tab is disposed in the port-closing disposition shown in full lines in FIG. 2. Thus, the shoulder releasably retains the stopper tab in the closed disposition effectively precluding inadvertent opening of the dispenser port.

As further illustrated fragmentarily in FIG. 2, the finger tip 23 slides along the camming surface 25 so as to act radially toward the axis 27 until the stopper tab reaches an intermediate position 23A. As the finger tip moves further beyond position 23A, the finger tip is deflected to a substantially greater degree and acts in a clockwise direction about the axis 27 as illustrated at position 23B. This tends to bias the stopper tab toward the open position illustrated in broken lines in FIG. 2.

As further illustrated in FIG. 2, concave portion 26 further defines a second rounded stop shoulder 30 generally opposite first rounded shoulder 29. As the finger tip moves from position 23B to the final position 23C, it rides up over rounded shoulder 30 until it is received behind the shoulder at position 23C so as to effectively retain the stopper tab in the fully open position shown in broken lines in FIG. 2 and in full lines in FIG. 1. As seen in FIG. 2, the finger tip is undeflected in the final position.

As further illustrated in FIG. 2, top wall 21 defines a limit shoulder 31 on the rearward outer portion of the concave wall 26, which is abutted by the stopper tab pivot portion 18 in the fully open arrangement of the stopper tab shown in broken lines therein. Thus, the stopper tab is effectively retained in the open position against pivotal movement therefrom by the limit shoulder 31 in the clockwise direction and the stop shoulder 30 in the counterclockwise direction. The resiliency of the finger 22, however, readily permits the user to overcome the resilient retention by fingertip urging of the stopper tab in a counterclockwise direction from the broken line position of FIG. 2 to the full line position in reclosing the closure cap.

Thus, the invention comprehends an improved cooperating camming surface on the closure cap end wall and resilient finger on the stopper tab providing a unique series of different conditions of biasing in the different positions of the stopper tab in the normal use thereof for selectively closing the dispenser port and permitting dispensing therethrough.

The foregoing disclosure of specific embodiments is illustrative of the broad inventive concepts comprehended by the invention.

I claim:

1. In a closure cap having a connecting portion and a distal end wall defining a dispenser port, and a stopper tab having a finger-manipulating portion, a stopper portion arranged to be fitted removably in said port for selectively closing said port, and a pivot portion pivotally mounted to said end wall, the improvement comprising:

a concave portion of said end wall defining a camming surface; and a resilient finger on said stopper tab having a tip portion slidably engaging said camming surface, said camming surface defining means for causing said finger tip to be deflected by its engagement with said camming surface when said stopper tab is arranged with said stopper portion received in said port so as to bias the stopper tab toward the axis of said pivot portion, said camming surface further defining means for causing said finger tip to bias the stopper tab pivotally toward an open position wherein the stopper portion is spaced from said port as a result of said stopper tab being moved from the port-closing disposition, and said camming surface further defining retaining means for causing the stopper tab to be releasably retained in a fully open pivotal position.

2. The closure cap structure of claim 1 wherein said end wall further defines shoulder means for engaging a portion of the stopper tab for releasably locking said stopper tab in said position wherein the stopper portion is received in said port.

3. The closure cap structure of claim 1 wherein said end wall further defines shoulder means on said camming surface for engaging a portion of the stopper tab for releasably locking said stopper tab in said position wherein the stopper portion is received in said port.

4. The closure cap structure of claim 1 wherein said end wall further defines shoulder means on said camming surface for engaging a portion of the stopper tab finger for releasably locking said stopper tab in said position wherein the stopper portion is received in said port.

5. The closure cap structure of claim 1 wherein said tip portion of the stopper tab finger portion is provided with a recess, and said end wall further defines shoulder means for engaging said tip portion in said recess for releasably locking said stopper tab in said position wherein the stopper portion is received in said port.

6. The closure cap structure of claim 1 wherein said means for causing the stopper tab to be releasably retained in the fully open pivotal position comprises shoulder means on said camming surface.

7. The closure cap structure of claim 1 wherein said means for causing the stopper tab to be releasably retained in the fully open pivotal position comprises shoulder means on said camming surface arranged to guide said finger tip therepast as the stopper tab is pivoted to the fully open position.

8. The closure cap structure of claim 1 wherein said means for causing the stopper tab to be releasably retained in the fully open pivotal position comprises shoulder means on said camming surface, said finger tip being substantially undeflected in a disposition pivotally beyond said shoulder means when the stopper tab is in the fully open position.

9. The closure cap structure of claim 1 wherein said end wall further defines a limit stop surface engaged by said stopper tab when the stopper tab is in the fully open position for preventing pivotal movement of the stopper tab beyond said fully open position.

10. The closure cap structure of claim 1 wherein said end wall concave portion further defines a limit stop surface engaged by said stopper tab when the stopper tab is in the fully open position for preventing pivotal movement of the stopper tab beyond said fully open position.

* * * * *